US007907865B2

(12) United States Patent
Ukai

(10) Patent No.: US 7,907,865 B2
(45) Date of Patent: Mar. 15, 2011

(54) IMAGE FORMING DEVICE CAPABLE OF PREVENTING WEAR TO ELECTRODES

(75) Inventor: Masamitsu Ukai, Nagoya (JP)

(73) Assignee: Brother Kogyo Kabushiki Kaisha, Nagoya-Shi (JP)

( * ) Notice: Subject to any disclaimer, the term of this patent is extended or adjusted under 35 U.S.C. 154(b) by 634 days.

(21) Appl. No.: 11/616,535

(22) Filed: Dec. 27, 2006

(65) Prior Publication Data

US 2007/0154233 A1 Jul. 5, 2007

(30) Foreign Application Priority Data

Dec. 27, 2005 (JP) ..... 2005-375596

(51) Int. Cl.
*G03G 15/00* (2006.01)

(52) U.S. Cl. ..... 399/90; 399/110

(58) Field of Classification Search ..... 399/90, 399/111, 107, 110
See application file for complete search history.

(56) References Cited

U.S. PATENT DOCUMENTS

| | | | | |
|---|---|---|---|---|
| 5,953,560 | A * | 9/1999 | Numagami et al. | 399/111 |
| 6,647,227 | B2 * | 11/2003 | Yokoi et al. | 399/111 |
| 6,708,011 | B2 * | 3/2004 | Nomura et al. | 399/110 |
| 6,804,475 | B2 | 10/2004 | Oguma et al. | |
| 6,944,415 | B2 | 9/2005 | Nomura | |
| 6,952,277 | B1 | 10/2005 | Ono | |
| 6,970,665 | B2 | 11/2005 | Kuma et al. | |

FOREIGN PATENT DOCUMENTS

| | | | |
|---|---|---|---|
| JP | 55156978 | | 12/1980 |
| JP | 03089284 | A | 4/1991 |
| JP | 4137374 | U | 6/1991 |
| JP | 4061769 | A | 2/1992 |
| JP | 5045942 | | 2/1993 |
| JP | 05064868 | | 8/1993 |
| JP | 8054817 | A | 2/1996 |
| JP | 8160840 | A | 6/1996 |
| JP | 11187190 | A | 7/1999 |
| JP | 2002137449 | | 5/2002 |
| JP | 2002268512 | A | 9/2002 |
| JP | 2002278413 | | 9/2002 |

(Continued)

OTHER PUBLICATIONS

Office Action in corresponding Chinese Patent Application No. 2006100636281, dated Apr. 24, 2009.

(Continued)

*Primary Examiner* — David P Porta
*Assistant Examiner* — Benjamin Schmitt
(74) *Attorney, Agent, or Firm* — Banner & Witcoff, Ltd.

(57) ABSTRACT

An image forming device includes an image-bearing unit and a unit accommodating section. The image-bearing unit includes a plurality of image forming unit each having an image bearing member on which an electrostatic latent image is formed. The image-bearing unit is detachably accommodated in the unit accommodating section by being inserted in a first direction. The image-bearing unit includes a first support member extending in a second direction orthogonal to the first direction and a first receiving electrode disposed on the first support member. The first receiving electrode receives electric power to be supplied to the image forming units. The unit accommodating section includes a first supplying electrode that contacts the first receiving electrode and supplies the electric power to the first receiving electrode.

19 Claims, 12 Drawing Sheets

FOREIGN PATENT DOCUMENTS

| | | | |
|---|---|---|---|
| JP | 2003107838 | A | 4/2003 |
| JP | 2003150022 | A | 5/2003 |
| JP | 2003280313 | | 10/2003 |
| JP | 2004151389 | A | 5/2004 |
| JP | 2004168015 | A | 6/2004 |

OTHER PUBLICATIONS

Office Action in corresponding Japanese Application No. 2005-375596, issued May 19, 2009, and English translation thereof.

Office Action issued Sep. 29, 2009 in corresponding Japanese Patent Application No. 2005-375596, and partial English translation thereof.

* cited by examiner

100
RIGHT
FRONT
REAR
LEFT
110
111
111a
111b
111c
112
112a
112b
112c
120
130
131
131a
132
132a
133a
(133)
134
134a
135
136
140
S

RIGHT
FRONT
LEFT
REAR
A
S
130
131
132
132b
133
134
135
135a
135b
136
136a
150

IMAGE FORMING DEVICE CAPABLE OF PREVENTING WEAR TO ELECTRODES

CROSS REFERENCE TO RELATED APPLICATION

This application claims priority from Japanese Patent Application No. 2005-375596 filed Dec. 27, 2005. The entire content of this priority application is incorporated herein by reference.

TECHNICAL FIELD

The disclosure relates to an image bearing unit including a plurality of image forming units provided with respective image bearing members onto which electrostatic latent images are formed. The invention also relates to an image forming device including a unit accommodating section for detachably accommodating the image bearing unit.

BACKGROUND

Conventional color laser printers generally include a drum unit that is detachably mounted in a main casing of the printer. The drum unit has a plurality of image forming units provided with respective photosensitive drums on which electrostatic latent images are formed.

A plurality of receiving electrodes for receiving electric power for each of the image forming units is arranged, on a wall of the drum unit, in a direction parallel to a drum-mounting direction in which the drum unit is inserted into the main casing. Also, a plurality of supplying electrodes for supplying electric power to the respective receiving electrodes is arranged on the main casing at appropriate positions such that the supplying electrodes are brought into contact with the corresponding receiving electrodes when the drum unit is mounted in the main casing (see U.S. Pat. No. 6,944,415, for example).

In this type of color laser printer, the receiving electrodes gride or slide over the corresponding supplying electrodes each time the drum unit is inserted into or removed from the main casing. As a result, these electrodes are worn with time.

Particularly, the receiving electrode disposed on the downstream side in the drum-mounting direction and the supplying electrode disposed on the upstream side in the drum-mounting direction are also grided by electrodes other than those corresponding thereto, during the inserting or detaching operation of the drum unit. Thus, those electrodes are worn to a large extent to give rise to a problem of contact failures, and enough electric power may not be supplied to the image forming units.

SUMMARY

In view of the foregoing, it is an object of the invention to provide an image bearing unit and an image forming device including the image bearing unit capable of preventing electrodes for supplying electric power to image forming units from being worn.

In order to attain the above and other objects, the invention provides an image forming device including: an image-bearing unit including a plurality of image forming units each having an image bearing member on which an electrostatic latent image is formed; and a unit accommodating section. The image-bearing unit is detachably accommodated in the unit accommodating section by being inserted in a first direction. The image-bearing unit includes a first support member extending in a second direction orthogonal to the first direction and a first receiving electrode disposed on the first support member. The first receiving electrode receives electric power to be supplied to the image forming units. The unit accommodating section includes a first supplying electrode that contacts the first receiving electrode and supplies the electric power to the first receiving electrode.

The invention further provides an image-bearing unit that is detachably mountable on a section of an image forming device by being inserted in an inserting direction. The image-bearing unit including: a plurality of image forming units each including an image-bearing member on which an electrostatic latent image is formed; a first support member extending in a direction perpendicular to the inserting direction; and a first receiving electrode that is disposed on the first support member. The first receiving electrode is configured to receive electric power to be supplied to the image forming units.

BRIEF DESCRIPTION OF THE DRAWINGS

Illustrative aspects in accordance with the invention will be described in detail with reference to the following figures wherein.

DETAILED DESCRIPTION

Figure 1:
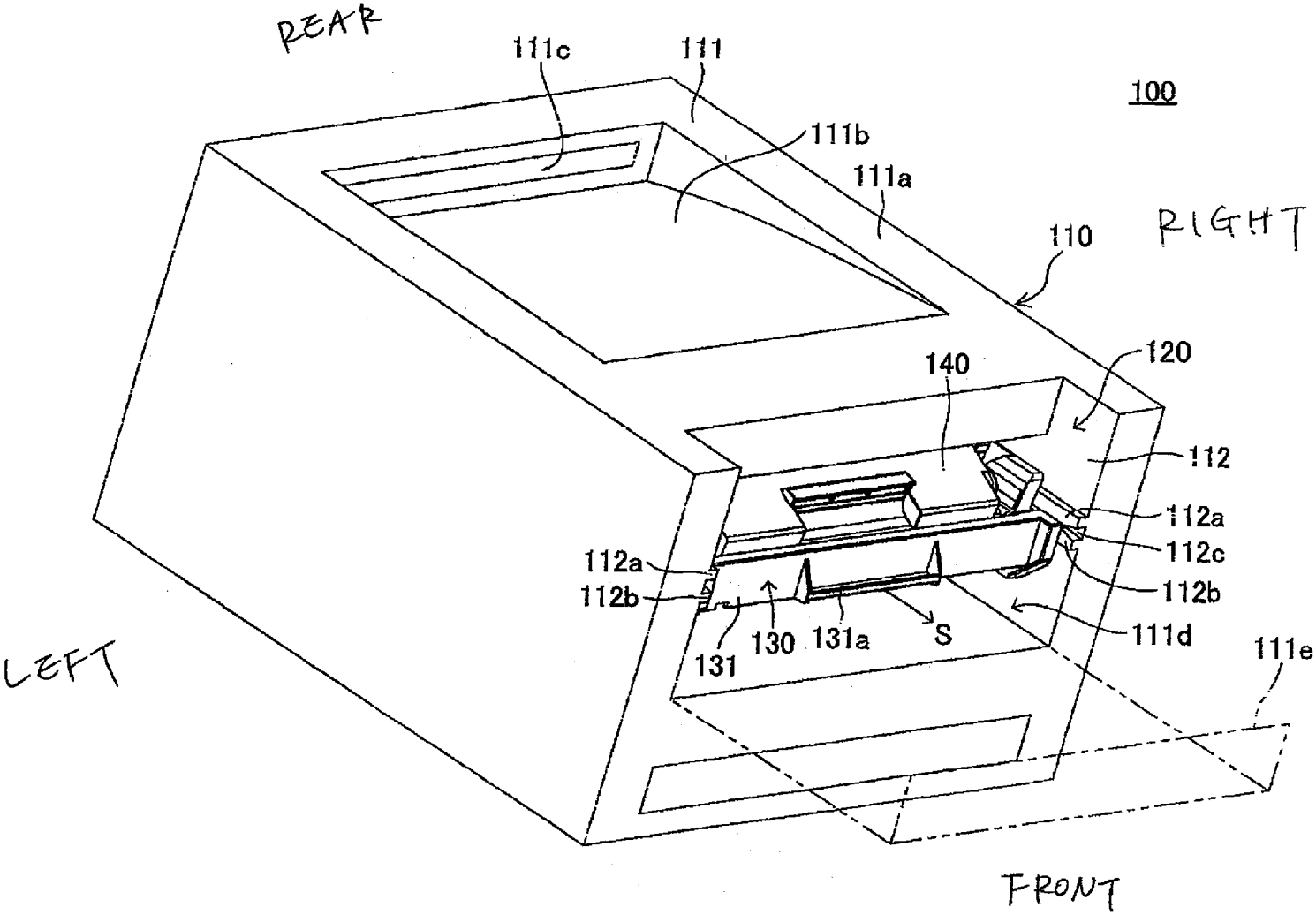
FIG. 1 is a perspective view showing the exterior of a printer according to some aspects of the invention.

An image forming device according to some aspects of the invention will be described while referring to the accompanying drawings wherein like parts and components are designated by the same reference numerals to avoid duplicating description.

FIG. 1 is a perspective view of a printer 100, to which the invention is applied, according to some aspects of the invention. Note that in the following description, the expressions "front", "rear", "left", "right", "above", and "below" are used to define the various parts when the printer 100 is disposed in an orientation in which it is intended to be used.

As shown in FIG. 1, the printer 100 includes a main body 110 having a main casing 111 and a main frame 112 housed inside the main casing 111.

The main casing 111 is formed of synthetic resin plates into a substantially box-shape. A sheet discharge tray 111*b* is formed in a top surface 111*a* of the main casing 111 so as to downwardly incline from the front side to the rear side of the main casing 111. A sheet discharge opening 111*c* is formed in the upper section of the main casing 111 at a position above the lower rear end of the sheet discharge tray 111*b*, for discharging sheets of paper onto the sheet discharge tray 111*b*.

A front-side opening 111*d* is formed in the front surface of the main casing 111. A front cover 111*e* is disposed at the front side of the main casing 111 for closing and exposing the front-side opening 111*d*. The front cover 111*e* is supported at the lower end thereof by the main casing 111.

The main frame 112 is for supporting various components that are accommodated in the main body 110 and that are used for image forming operations. The main frame 112 is also provided with a drive source and a drive power transmission mechanism for driving the various components to rotate. The main frame 112 is provided with a pair of upper guide rails 112*a* and a pair of lower guide rails 112*b*. The upper guide rails 112*a* are formed to inwardly protrude from left and right inner surfaces of the main frame 112 to confront each other in a widthwise direction (left-to-right direction) of the printer 100. Each of the upper guide rails 112*a* extends substantially horizontally in a front-to-rear direction S of the printer 100. Similarly, the lower guide rails 112*b* are formed to inwardly protrude from the left and right inner surfaces of the main frame 112 to confront each other in the widthwise direction of the printer 100. The pair of lower guide rails 112*b* is disposed substantially parallel to the pair of upper guide rails 112*a*. A pair of guide grooves 112*c* is defined between the upper guide rails 112*a* and the lower guide rails 112*b*.

Figure 2:
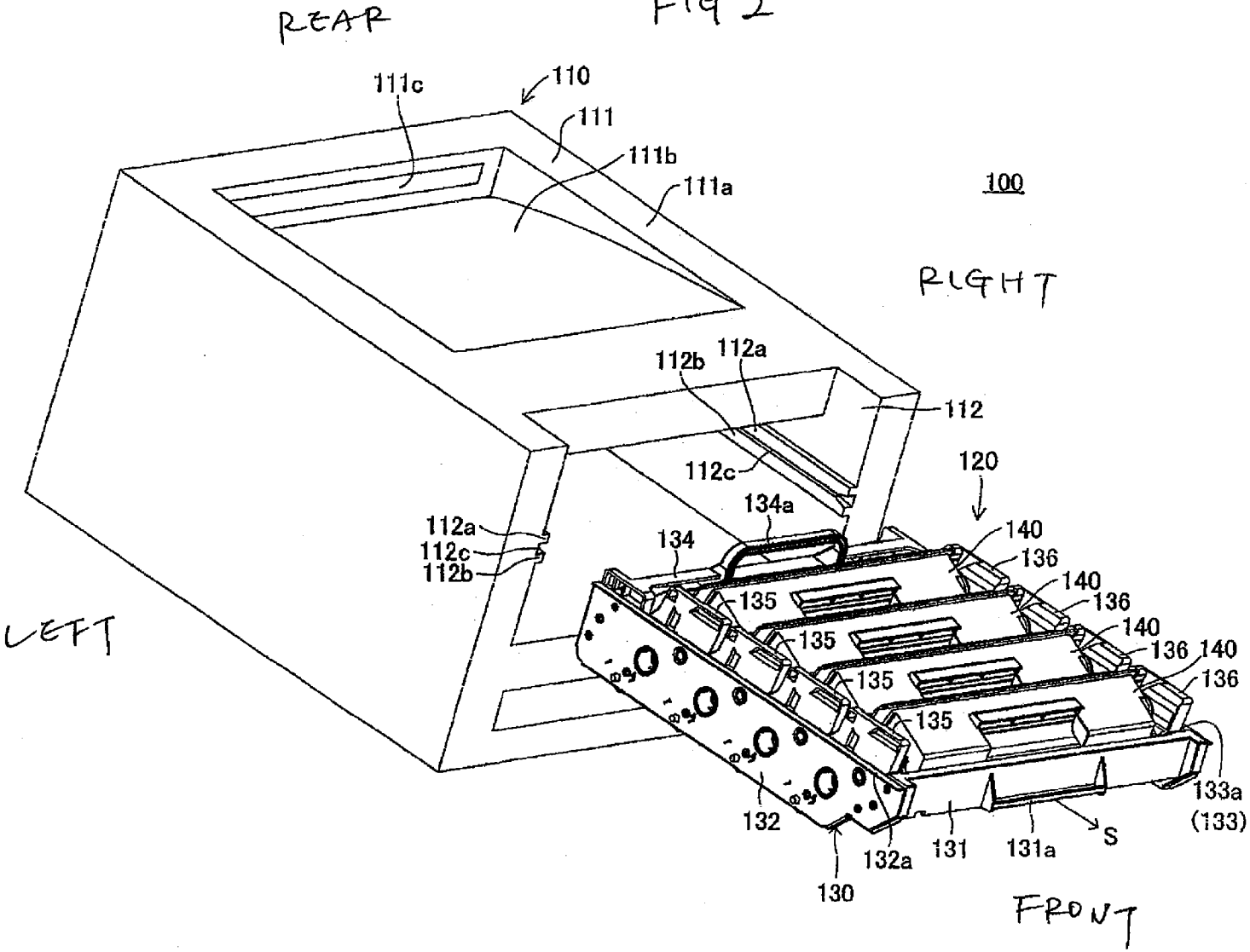
FIG. 2 is a perspective view of the printer in FIG. 1 with an image forming unit being taken out from a main section of the printer.

An image forming unit 120 is disposed inside the main frame 112 such that the image forming unit 120 can be pulled out of the main frame 112 through the front side thereof, as shown in FIG. 2. More specifically, a user can remove the image forming unit 120 from the main body 110 by first opening the front cover 111*e*, grabbing a front handle 131*a* provided to the front end of the image forming unit 120, and pulling the image forming unit 120 toward the front.

As shown in FIG. 2, the image forming unit 120 includes a drum unit 130 and four developing cartridges 140. The drum unit 130 includes a frame configured of a front beam 131, a pair of support plates 132 and 133, a rear beam 134, and four pairs of side plates 135 and 136, into a rectangular shape in a plan view.

The front beam 131 and the rear beam 134 are disposed to the front side and the rear side, respectively. The support plates 132 and 133 are linked to the widthwise ends of the front beam 131 and those of the rear beam 134. The pairs of side plates 135 and 136 are supported by the support plates 132 and 133 so as to be located therebetween and extend therealong. The pairs of side plates 135 and 136 are arranged in the front-to-rear direction S. The developing cartridges 140 are arranged in a row in the front-to-rear direction S, such that each developing cartridge 140 is located between a corresponding one of pairs of side plates 135 and 136. Each of the developing cartridges 140 is detachably supported by the drum unit 130 by means of the side plates 135 and 136.

Flange sections 132*a* and 133*a* are formed at upper edges of the support plates 132 and 133, respectively. The flange sections 132*a* and 133*a* are capable of engaging the guide grooves 112*c* of the main frame 112. Thus, the drum unit 130 is guided by the flange sections 132*a* and 133*a* and the guide grooves 112*c* when being inserted into the main frame 112.

An inverted U-shaped rear handle 134*a* is formed on an upper end of the rear beam 134. Thus, the user can easily carry the image forming unit 120 (the drum unit 130) by holding the rear handle 134*a* and the front handle 131*a* that is formed on the front surface of the front beam 131.

Figure 3:
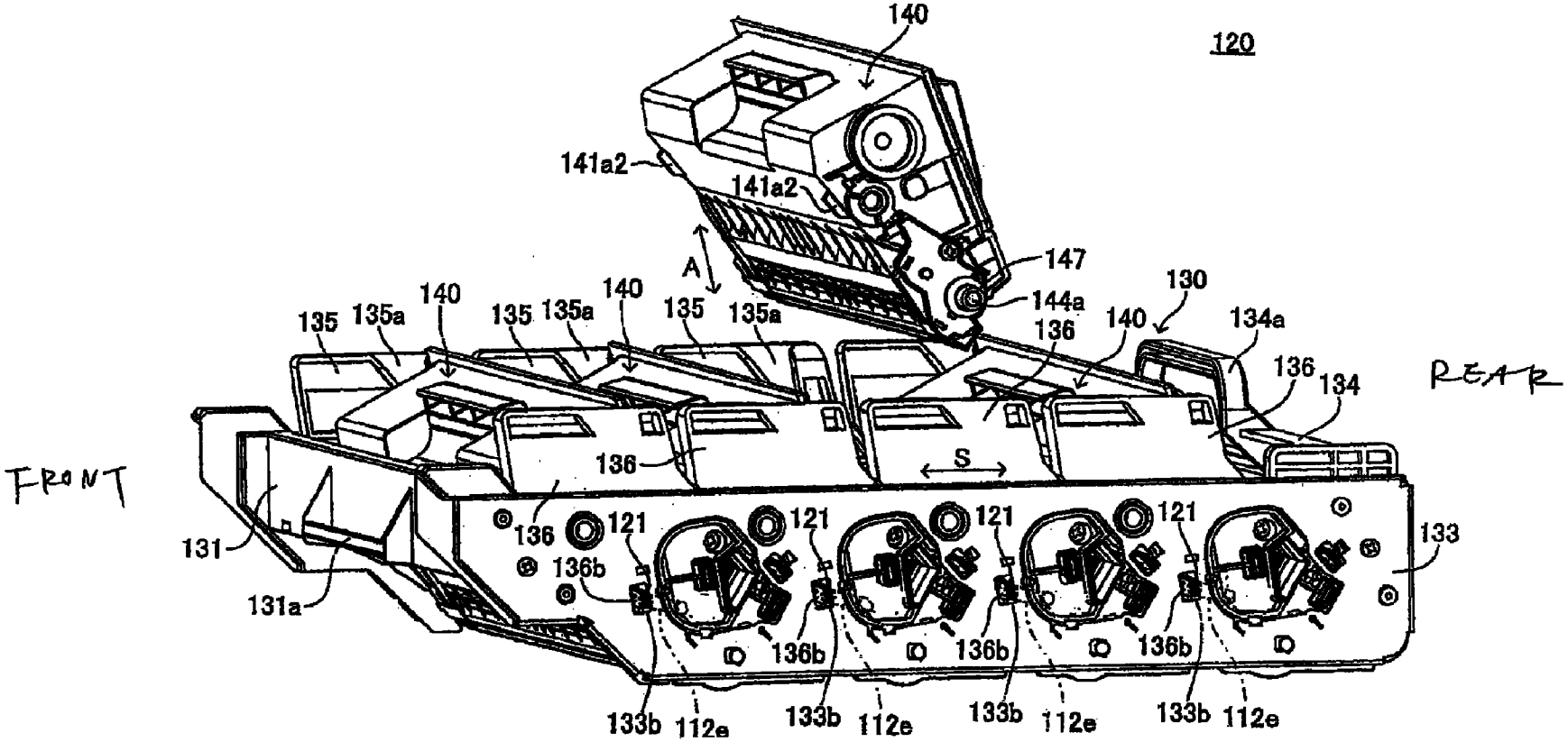
FIG. 3 is a perspective view of a drum unit of the image forming unit with one of developing cartridges being detached from the drum unit.
Figure 4:
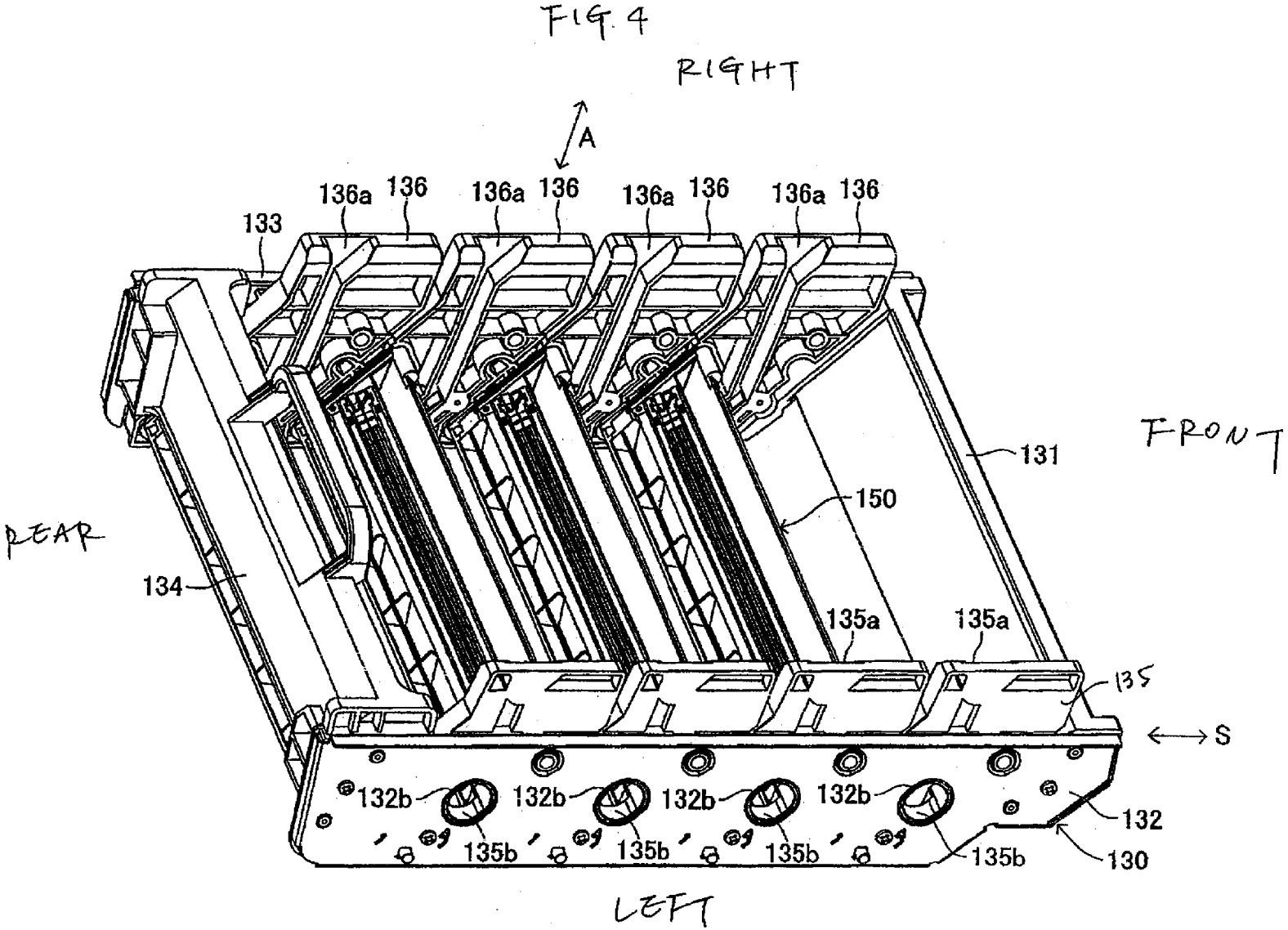
FIG. 4 is a perspective view of the drum unit in FIG. 3 with all the developing cartridges being detached therefrom.

FIG. 3 is a perspective view of the drum unit 130 with one of the developing cartridges 140 detached therefrom. FIG. 4 is a perspective view of the drum unit 130 with all the developing cartridges 140 are detached therefrom. As shown in FIGS. 3 and 4, guide grooves 135*a* and 136*a* (only the guide grooves 135*a* are shown in FIG. 3) are formed in the inner surfaces of the side plates 135 and 136, respectively, for guiding the developing cartridges 140 in the vertical direction A.

As shown in FIG. 3, each of the developing cartridges 140 is provided with a pair of collar members 147 outwardly protruding one from either ends of the developing cartridge 140 in the widthwise direction. The color members 147 are made of an electrically conductive material and are configured to engage the corresponding guide grooves 135*a* and 136*a* of the side plates 135 and 136. A pair of leg sections 141*a*2 is formed one at either widthwise end of the lower surface of each of the developing cartridges 140, enabling the user to stably place the developing cartridge 140 on a work bench or a table.

The support plate 133 is formed with four electrode through holes 133*b* arranged in the front-to-rear direction S so as to oppose the corresponding developing cartridges 140. An electrode support section 136*b* is formed on each of the side plates 136 and supports a corresponding one of receiving electrodes 121. The receiving electrodes 121 are for receiving power to be applied to the corresponding developing cartridges 140. Both the electrode support sections 136*b* and the receiving electrodes 121 supported thereon project from the corresponding electrode through holes 133*b*. When the image forming unit 120 is mounted in the main frame 112, the receiving electrodes 121 respectively abut corresponding supplying electrodes 112*e* arranged in the main frame 112 and receive electric power from the supplying electrodes 112*e*.

As will be described later, each developing cartridge 140 includes a developing roller 144 (FIG. 11) having a metal rotary shaft 144*a*, which penetrates through the corresponding color member 147. When the developing cartridge 140 is fully inserted into the drum unit 130, one of the collar members 147 of the developing cartridge 140 contacts the corresponding receiving electrode 121, and also the rotary shaft 144*a* is electrically connected to the corresponding receiving electrode 121.

As shown in FIG. 4, the support plate 132 is formed with four coupling through holes 132*b* arranged in the front-to-rear direction S so as to oppose the corresponding developing cartridges 140. Each of the side plates 135 is formed with a coupling exposing hole 135*b* at a position opposing the corresponding coupling through hole 132*b*. Each of the coupling through holes 132*b* and the corresponding coupling exposing hole 135*b* are provided for receiving a corresponding input shaft (not shown) of the main frame 112 that is engaged with a gear coupling (not shown) of each developing cartridge 140 for applying power to the gear coupling.

Four drum sections 150 are arranged in the front-to-rear direction S at the bottom section of the drum unit 130 so as to oppose the corresponding developing cartridges 140.

Figure 5:
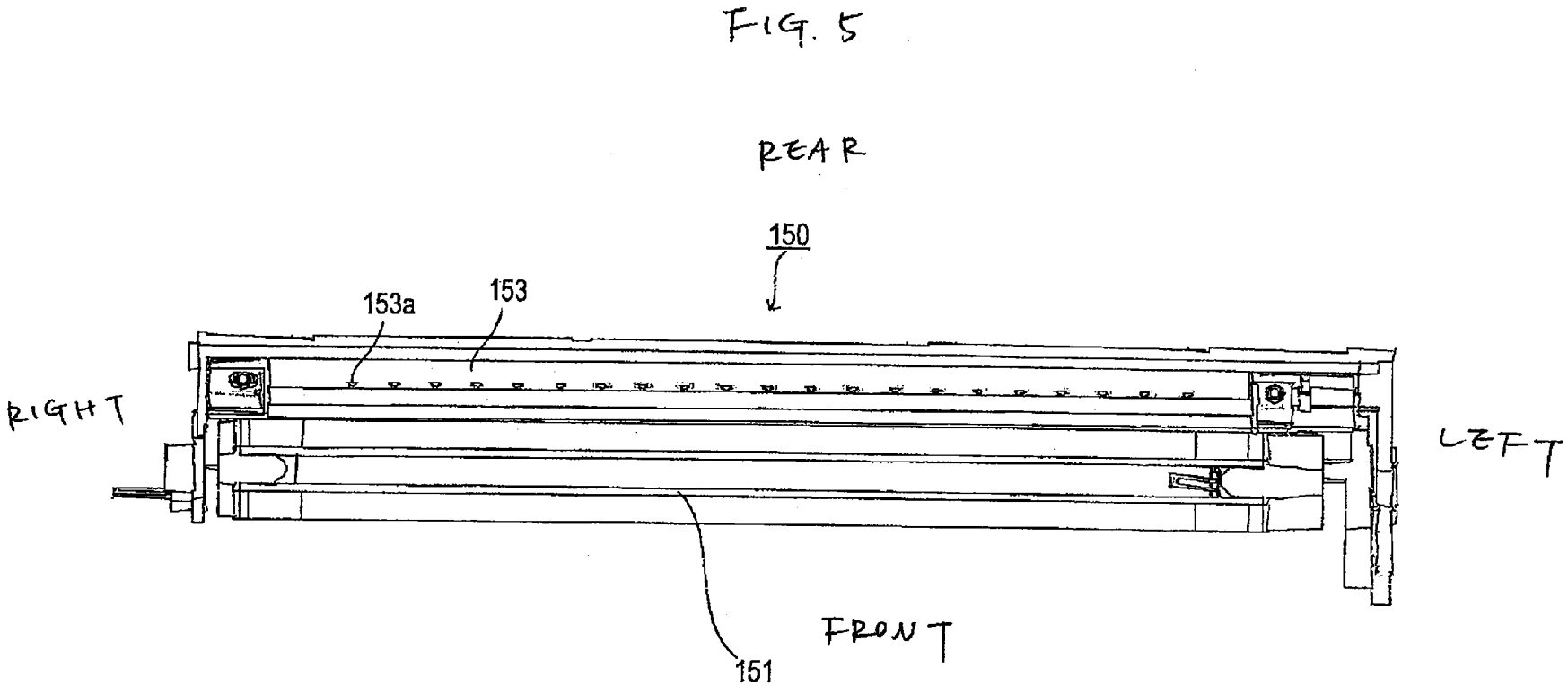
FIG. 5 is a cross-sectional view of one of drum sections of the drum unit as viewed from the bottom.

FIG. 5 is a cross sectional view of one of the drum sections 150 as viewed from the bottom. As shown in FIG. 5, each of the drum sections 150 includes a photosensitive drum 151 and an LED substrate 153 disposed in opposition to the photosensitive drum 151. A plurality of LEDs 153*a* is disposed on the LED substrate 153. The LEDs 153*a* are arranged in a row in the widthwise direction and confront the photosensitive drum 151. The LEDs 153*a* are electrically connected in parallel on the LED substrate 153.

Figure 6:
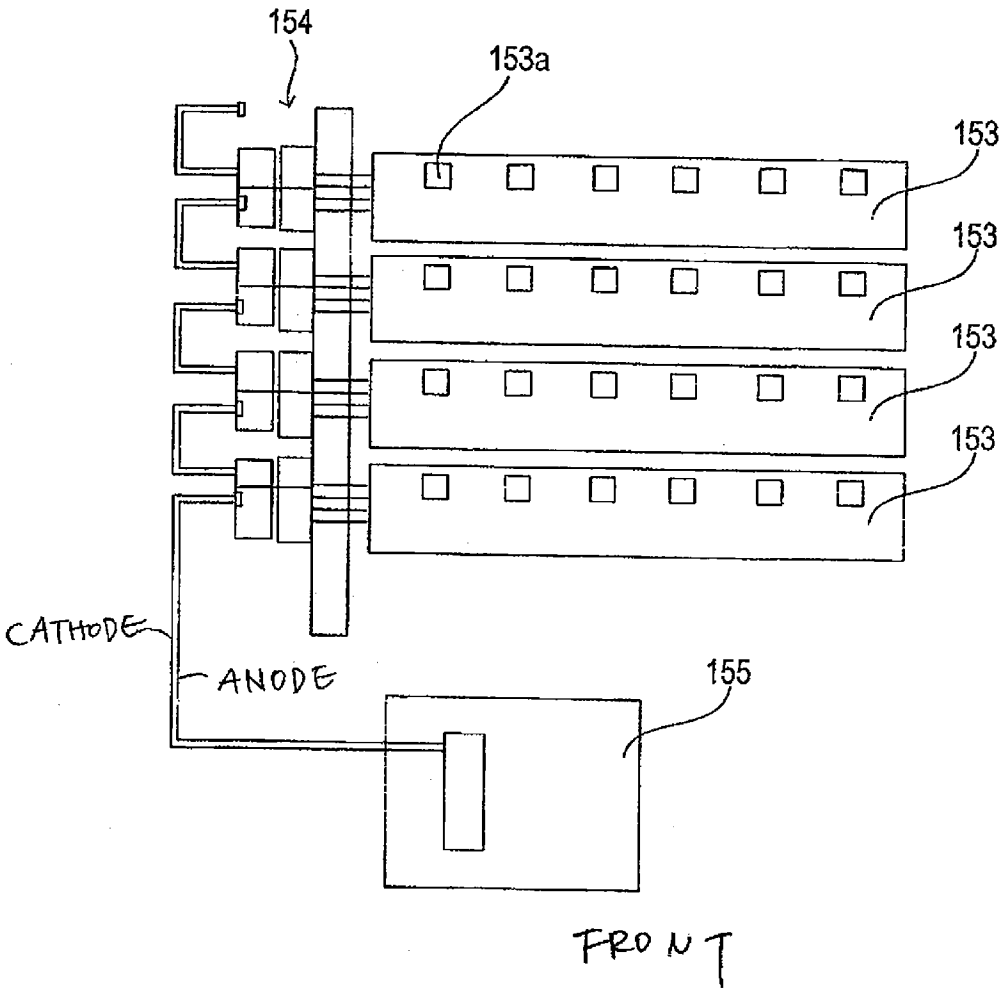
FIG. 6 is an explanatory view showing a wiring system among LED substrates of the drum unit.

FIG. 6 is an explanatory view showing the wiring system among the LED substrates 153 of the drum unit 130. As shown in FIG. 6, the LED substrates 153 are linked to each other by means of a harness 154. More specifically, the harness 154 connects a connection substrate 155, which is connected to a pair of receiving electrodes 131*b* and 131*c* (see FIG. 7), and the LED substrate 153 disposed nearest the front, thereby connecting the receiving electrodes 131*b* and 131*c* to the anode side and the cathode side of the LEDs 153*a*, respectively. The harness 154 also connects each of the LED substrates 153 to the adjacent one of the LED substrates 153 in the front-to-rear direction, so that groups of the LEDs 153*a* on the LED substrates 153 are connected to each other in parallel. Note that the harness 154 that is connected to the LED substrate 153 disposed nearest the rear has an open end.

Figure 7:
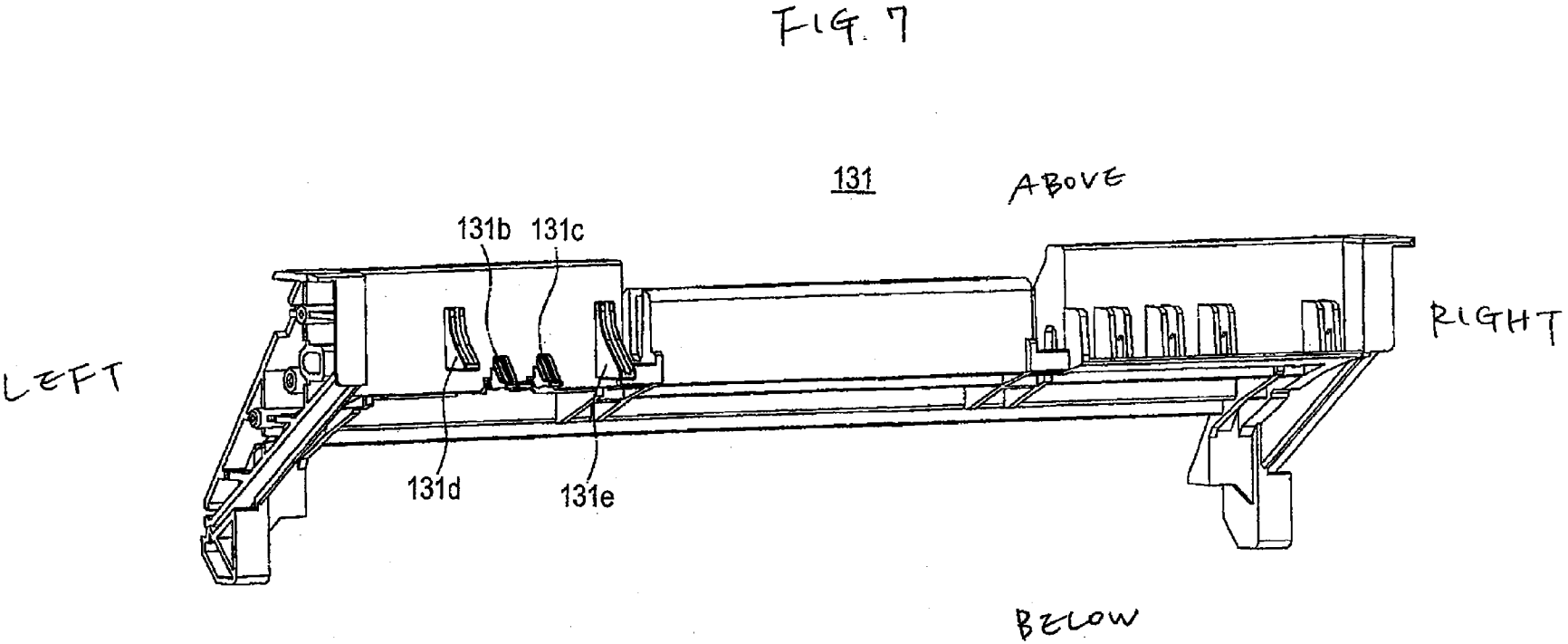
FIG. 7 is a perspective view of a front beam of the drum unit.

FIG. 7 is a perspective view of the front beam 131 of the drum unit 130 as viewed from the front right side thereof. Note that the front handle 131*a* is omitted in FIG. 7. As shown in FIG. 7, the pair of receiving electrodes 131*b* and 131*c* mentioned above is provided at the left section of the front surface of the front beam 131 so as to project forward.

A pair of guide members 131*d* and 131*e* project forward from the front surface of the front beam 131 so as to interpose the pair of receiving electrodes 131*b* and 131*c* between the guide members 131*d* and 131*e*.

Figure 8:
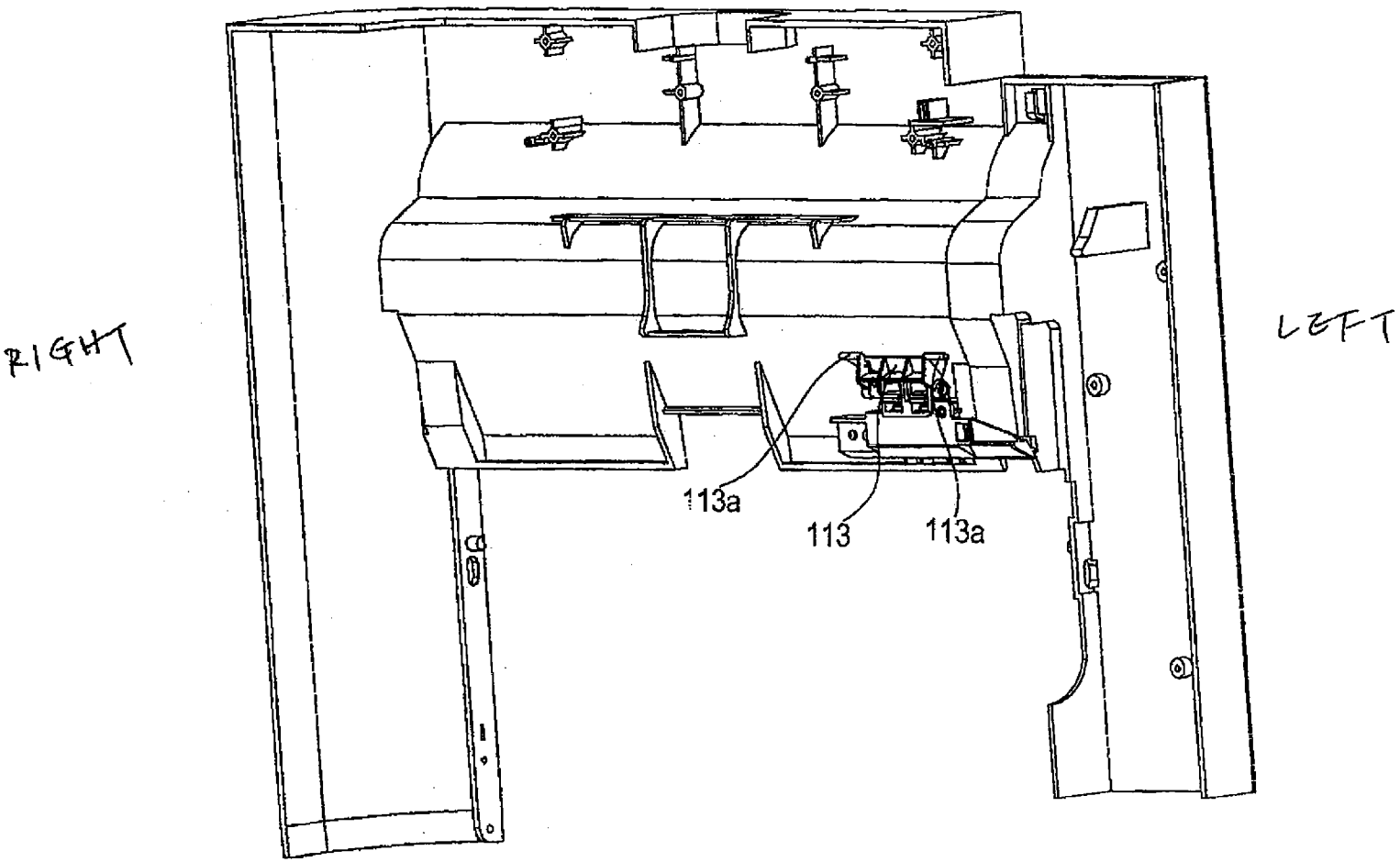
FIG. 8 is a perspective view of a front cover of the main casing.

FIG. 8 is a perspective view of the front cover 111*e* in the closed state, as viewed from inside the main body 110. As shown in FIG. 8, a shutter member 113 is supported by the front cover 111*e* at a position opposing the receiving electrodes 131*b* and 131*c* of the front beam 131 when the image forming unit 120 is mounted in the main frame 112 and the front cover 111*e* is in the closed state. The shutter member 113 can swing upward. A pair of pressed members 113*a* is integrally formed to the shutter member 113, one at either widthwise end thereof. The guide members 131*d* and 131*e* of the front beam 131 (FIG. 7) abut and press the respective pressed members 113*a* when the front cover 111*e* is closed.

Figure 9:
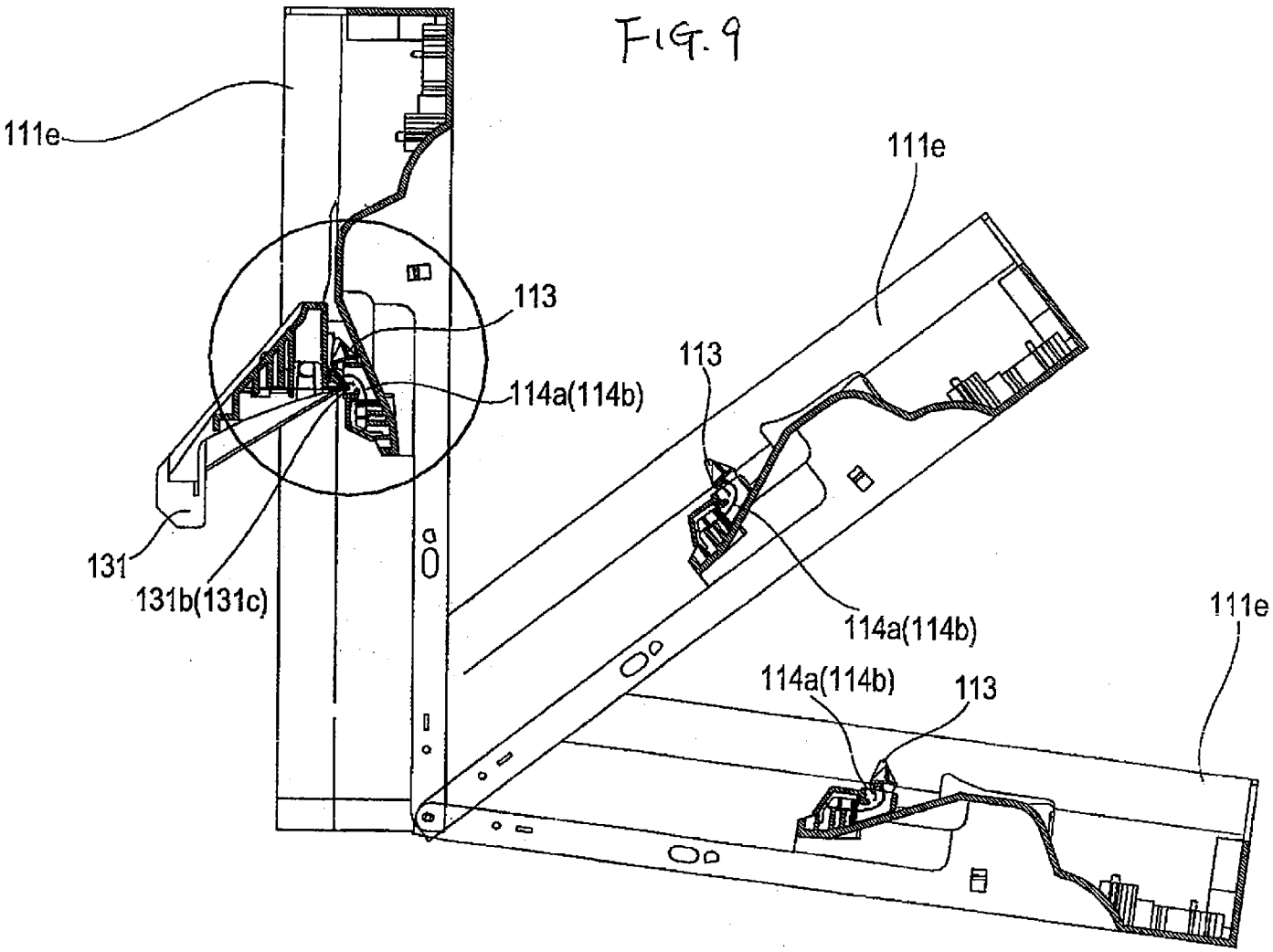
FIG. 9 is a side cross-sectional view of the front cover, showing how the shutter member is displaced.
Figure 10:
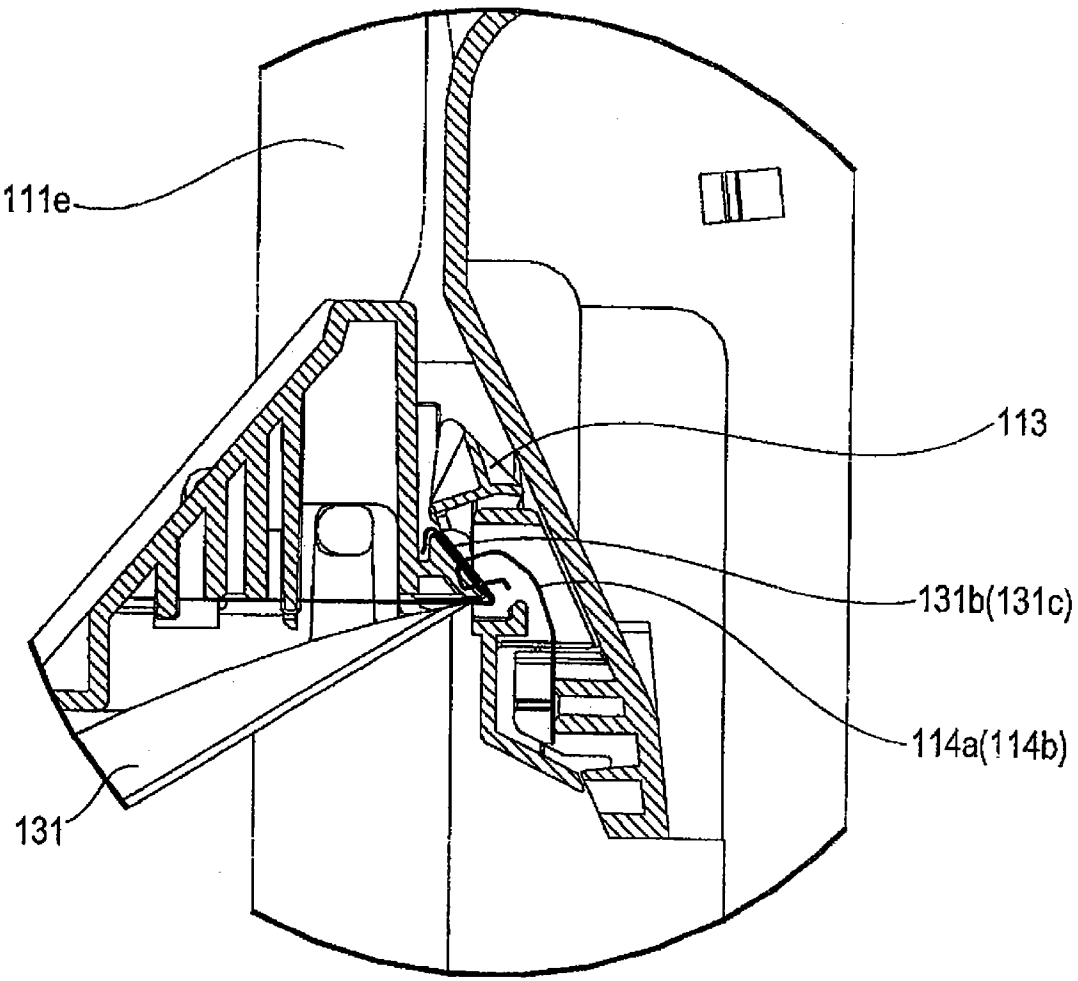
FIG. 10 is an enlarged view of the part encircled in FIG. 9.

FIG. 9 is a cross-sectional view of the front cover 111*e*, showing how the shutter member 113 is displaced. FIG. 10 is an enlarged view of a part of the front cover 111*e* encircled in FIG. 9.

As shown in FIG. 9, a pair of supplying electrodes 114*a* and 114*b* is provided on the front cover 111*e*. The supplying electrode 114*a* is connected to the anode of a power source (not shown) for supplying electric power to the LED substrates 153, while the supplying electrode 114*b* is connected to the grounding of the power source. The supplying electrodes 114*a* and 114*b* are covered with the shutter member 113 when the front cover 111*e* is in the open state. This prevents the supplying electrodes 114*a* and 114*b* from being contacted by the user or other components of the printer 100. However, the supplying electrodes 114*a* and 114*b* are exposed when the shutter member 113 swings upward.

Specifically, when the front-side opening 111*d* of the main casing 111 is closed by the front cover 111*e* with the image forming unit 120 being mounted in the main frame 112, the guide members 131*d* and 131*e* of the front beam 131 respectively abut the pressed members 113*a* and 113*a* of the shutter member 113 to upwardly displace the shutter member 113. As a result, as shown in FIGS. 9 and 10, the supplying electrodes 114*a* and 114*b* that have been covered with the shutter member 113 become exposed, and respectively contact the receiving electrodes 131*b* and 131*c* of the front beam 131.

Although not shown in the drawings, a spring is attached to the shutter member 113. When the user opens the front cover 111*e*, the shutter member 113 automatically swings downward and covers the supplying electrodes 114*a* and 114*b* due to the urging force of the spring. Therefore, the supplying electrodes 114*a* and 114*b* are reliably prevented from being contacted by the user or other components of the printer 100 when the front cover 111*e* is opened.

Figure 11:
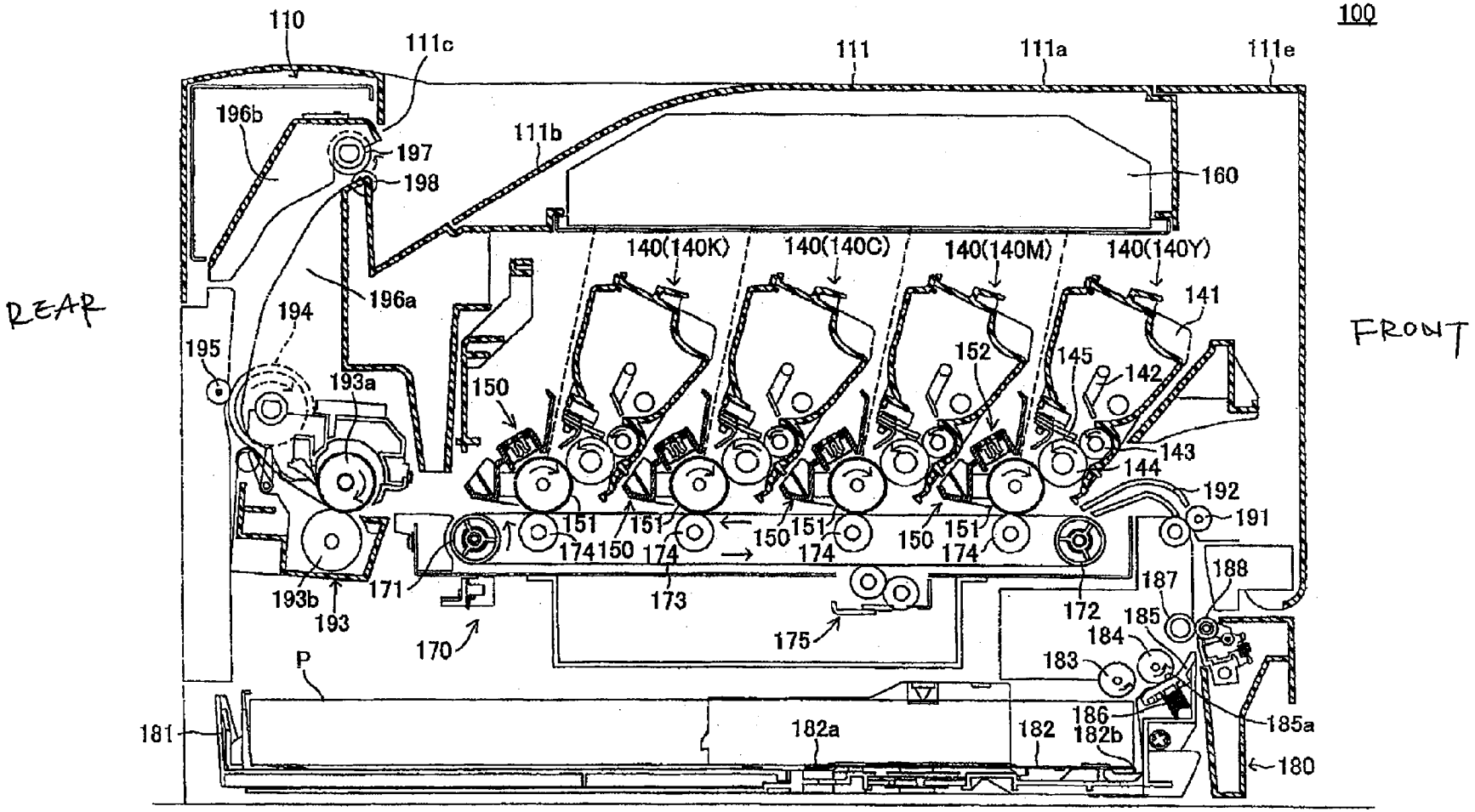
FIG. 11 is a side cross-sectional view of the printer with the image forming unit mounted therein.

FIG. 11 is a side cross-sectional view of the printer 100 with the image forming unit 120 mounted therein. As shown in FIG. 11, the four developing cartridges 140 (140K, 140C, 140M, 140Y) are arranged in a row in the front-to-rear direction within the main body 110 of the printer 100. The four drum sections 150 are arranged in confrontation with the corresponding developing cartridges 140. A scanner unit 160 and a transfer unit 170 are disposed respectively above and below both the developing cartridges 140 and the drum sections 150. A feeder unit 180 is disposed below the transfer unit 170.

The developing cartridges 140K, 140C, 140M, and 140Y respectively contain toners of different colors of black, cyan, magenta, and yellow. Note that the developing cartridges 140K, 140C, 140M, and 140Y are identical with each other except that they contain toners of different colors.

Each of the developing cartridges 140 includes a cartridge case 141 that accommodates toner. The developing cartridge 140 further includes an agitator 142, a supply roller 143, the developing roller 144, and a blade 145, all supported within the cartridge case 141.

The agitator 142 is for agitating the toner accommodated in the cartridge case 141, and is rotatably supported by the cartridge case 141. The supply roller 143 is a sponge roller rotatably supported by the cartridge case 141. The developing roller 144 is a rubber roller rotatably supported by the cartridge case 141. The supply roller 143 and the developing roller 144 are disposed such that outer peripheral surfaces thereof contact with each other. As the supply roller 143 is driven to rotate counterclockwise in FIG. 11, electrically charged toner is supplied to the outer peripheral surface of the developing roller 144. A developing bias voltage is applied to the rotary shaft 144*a* of the developing roller 144 from the corresponding supplying electrode 112*e* (FIG. 3) for causing toner to adhere to the outer peripheral surface of the corresponding photosensitive drum 151.

The blade 145 contacts the outer peripheral surface of the developing roller 144 so as to adjust the quantity of toner on the outer peripheral surface of the developing roller 144 while the developing roller 144 is driven to rotate counterclockwise in FIG. 11.

Figure 12:
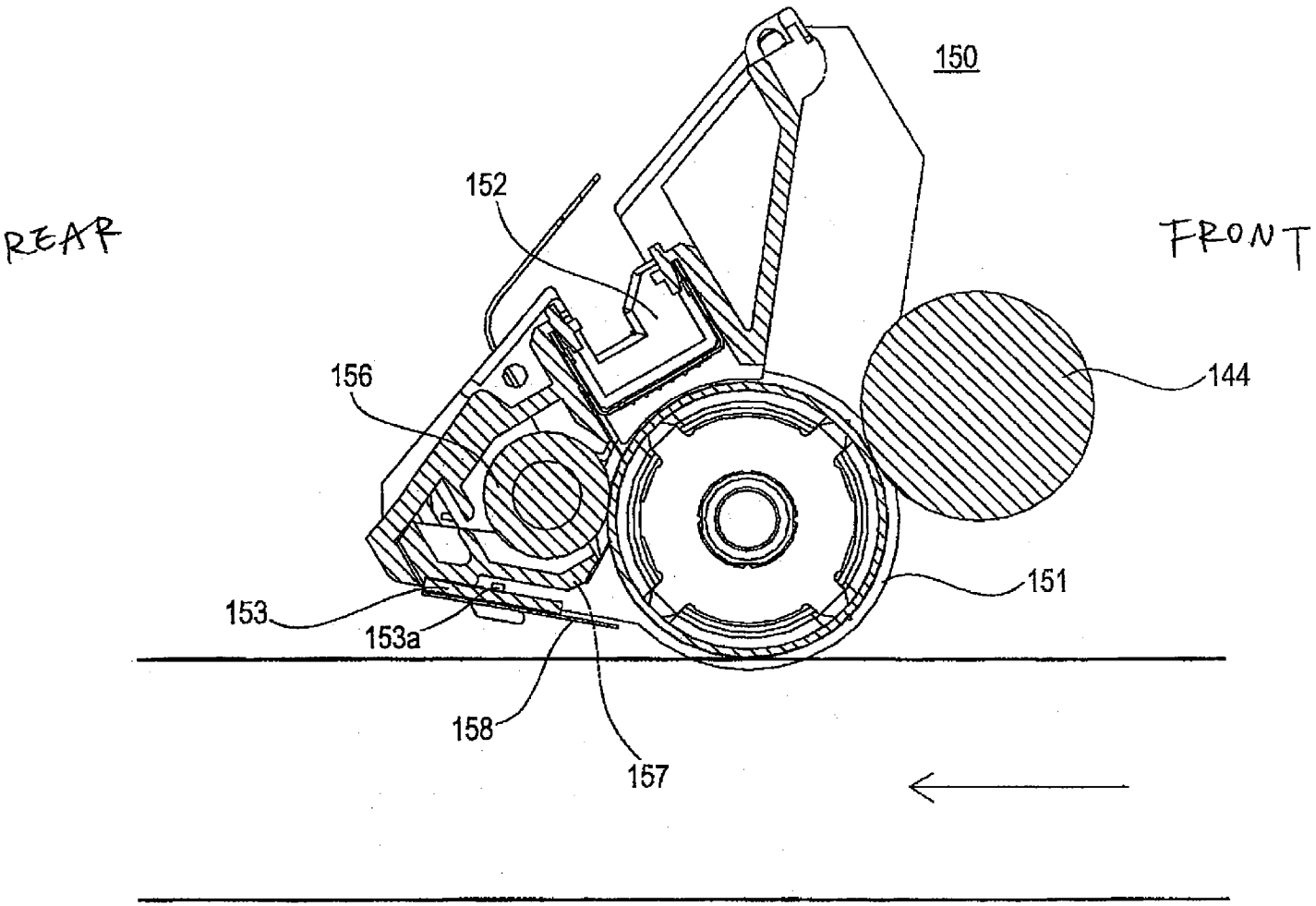
FIG. 12 is a detailed cross-sectional view of one of the drum sections.

The four drum sections 150 have an identical configuration with each other. FIG. 12 is a side cross-sectional view of one of the drum sections 150. As shown in FIG. 12, each of the drum sections 150 has the photosensitive drum 151, a Scorotron charger 152, a cleaning roller 156, a cleaning cabinet 157, and the LED substrate 153.

The photosensitive drum 151 has a photosensitive layer made of a photoconductor formed on the outer peripheral surface thereof. The photosensitive drum 151 is disposed such that the outer peripheral surface thereof opposes the outer peripheral surface of the developing roller 144. A rotary shaft of the photosensitive drum 151 is supported by the drum unit 130 such that the photosensitive drum 151 can be driven to rotate clockwise in FIG. 12. The rotary shaft of the photosensitive drum 151 extends in the widthwise direction (that is, a direction perpendicular to the sheet surface of FIG. 12) orthogonal to the mounting direction of the drum unit 130, which is the front-to-rear direction.

The charger 152 is disposed above the photosensitive drum 151 so as to oppose the outer peripheral surface of the photosensitive drum 151. The charger 152 applies a uniform charge across the entire surface of the photosensitive drum 151.

The cleaning roller 156 is made of a sponge member and is disposed to the rear of the photosensitive drum 151 so as to press the photosensitive drum 151 to a predetermined pressure level. The cleaning roller 156 is supported by the drum unit 130 so as to rotate following the rotation of the photosensitive drum 151. The cleaning cabinet 157 surrounds the cleaning roller 156.

The LED substrate 153 is disposed below the cleaning roller 156. The upper and lower sides of the LED substrate 153 are protected by the cleaning cabinet 157 and a film member 158, respectively. The lower surface of the cleaning cabinet 157 and the upper surface of the film member 158 are coated with light reflecting paint in order to efficiently lead light emitted from the LED 153*a* to the outer peripheral surface of the photosensitive drum 151.

As shown in FIG. 11, the scanner unit 160 includes a laser beam emitting section (not shown) that emits a laser beam based on image data for scanning the laser beam on the outer peripheral surface of the photosensitive drum 151 in the widthwise direction (the direction perpendicular to the sheet surface of FIG. 11).

The transfer unit 170 includes a belt driving roller 171, a follower roller 172, a conveyer belt 173, four transfer rollers 174, and a belt cleaner 175. The belt driving roller 171 is disposed to the rear of one of the drum sections 150 disposed nearest the rear. The follower roller 172 is disposed to the front of one of the drum sections 150 disposed nearest the front. The belt driving roller 171 and the follower roller 172 are rotatably supported by the main body 110.

The conveyor belt 173 is an endless belt made of electrically conductive resin film, such as polycarbonate or polyimide, dispersed with electrically conductive particles of carbon or the like. The conveyor belt 173 is wound on the belt driving roller 171 and the follower roller 172. As the belt driving roller 171 is driven to rotate counterclockwise in FIG. 11, the conveyor belt 173 rotates counterclockwise in FIG. 11 and conveys a sheet of paper P supported on the conveyor belt 173 from the front side to the rear side.

Each of the transfer rollers 174 is disposed below the corresponding one of the photosensitive drums 151 such that the transfer roller 174 confronts the corresponding photosensitive drum 151 with the conveyor belt 173 interposed therebetween. Each transfer roller 174 is rotatably supported and rotates as the conveyor belt 173 rotates counterclockwise in FIG. 11. A transfer bias voltage for transferring toner from the photosensitive drum 151 toward the conveyor belt 173 (the sheet of paper P) is applied to the transfer roller 174. The belt cleaner 175 is disposed below the conveyor belt 173 for cleaning the surface of the conveyor belt 173.

The feeder unit 180 includes a feeder case 181, a feed roller 183, a separation roller 184, a separation pad 185, and a paper dust removing roller 187.

The feeder case 181 accommodates a stack of large number of sheets of paper P. A sheet pressing plate 182 is disposed inside the feeder case 181. The sheet pressing plate 182 is pivotably supported at its rear end 182*a* so that its front end 182*b* can move upward and downward.

The feed roller 183 is made of synthetic rubber member. The feed roller 183 is supported by the main body 110, at a position above the front end 182*b* of the sheet pressing plate 182, so as to be driven to rotate counterclockwise in FIG. 11. As the feed roller 183 is driven to rotate counterclockwise in FIG. 11, the feed roller 183 conveys the uppermost sheet of paper P stacked in the feeder case 181 toward the front.

The separation roller 184 is made of synthetic rubber material, and is supported by the main body 110 to the front of the feed roller 183 so as to be driven to rotate counterclockwise in FIG. 11. The separation pad 185 is disposed in confrontation with the separation roller 184. A separation surface 185*a* of the separation pad 185 that faces the separation roller 184 is made of a material having a high frictional coefficient, such as synthetic rubber or felt. An urging spring 186 is disposed below the separation pad 185 for urging the separation pad 185 toward the separation roller 184, pressing the separation pad 185 against the separation roller 184.

The paper dust removing roller 187 is for removing paper dust adhering to sheets of paper P. The paper dust removing roller 187 is disposed above the separation roller 184 to confront a pinch roller 188.

A sheet conveyor roller 191 and a sheet guide member 192 are disposed to the front of the follower roller 172. The sheet of paper P that is conveyed from the feeder unit 180 is conveyed further toward the conveyor belt 173 by the sheet conveyor roller 191 and the sheet guide member 192.

A fixing unit 193 is disposed to the rear of the belt driving roller 171. The fixing unit 193 includes a heating roller 193*a* and a pressure roller 193*b*. The heating roller 193*a* includes a metal cylinder, whose surface is processed for mold releasing, and a halogen lamp disposed inside the cylinder.

The heating roller 193*a* is supported by the main body 110 so as to be driven to rotate clockwise in FIG. 11. The pressure roller 193*b* is made of silicon rubber. The pressure roller 193*b* presses against the heating roller 193*a* with a predetermined pressure. The pressure roller 193*b* is supported by the main body 110 so as to be rotatable counterclockwise in FIG. 11, following the rotary motion of the heating roller 193*a*.

With this configuration, while the rotation of the heating roller 193*a* conveys the sheet of paper P toward the sheet discharge opening 111*c*, the toner on the sheet of paper P is fused and rigidly fixed to the sheet of paper P.

A fixed sheet conveyor roller 194 and a pinch roller 195 are disposed to the rear of and diagonally above the fixing unit 193. The fixed sheet conveyor roller 194 is supported by the main body 110 so as to be driven to rotate clockwise in FIG. 11. On the other hand, the pinch roller 195 is disposed in confrontation with the fixed sheet conveyor roller 194 and is supported by the main body 110 so as to be able to rotate following the rotary motion of the fixed sheet conveyor roller 194. The fixed sheet conveyor roller 194 and the pinch roller 195 together convey the sheet of paper P with images fixed thereon toward the sheet discharge opening 111*c* as the fixed sheet conveyor roller 194 is driven to rotate clockwise in FIG. 11.

Fixed sheet guides 196*a* and 196*b* are disposed above the fixed sheet conveyance roller 194 and the pinch roller 195. The fixed sheet guide rollers 196*a* are 196*b* guide the sheet of paper P conveyed by the fixed sheet conveyor roller 194 and the pinch roller 195 toward a contact area of a sheet discharge roller 197 and a sheet discharge follower roller 198.

The sheet discharge roller 197 and the sheet discharge follower roller 198 are disposed near the sheet discharge opening 111*c* so as to confront the same. The sheet discharge roller 197 is rotatably supported by the main body 110 so as to be able to be driven to rotate counterclockwise in FIG. 11. The sheet discharge follower roller 198 is disposed in confrontation with the sheet discharge roller 197 and is rotatably supported by the main body 110 so as to be able to rotate following the rotary motion of the sheet discharge roller 197.

With this configuration, the sheet discharge roller 197 and the sheet discharge follower roller 198 together discharge the sheet of paper P to the outside the main body 110 through the sheet discharge opening 111*c*, as the sheet discharge roller 197 is driven to rotate counterclockwise in FIG. 11.

An image forming operation of the printer 100 will be described next.

As the feed roller 183 is driven to rotate counterclockwise in FIG. 11, the sheets of paper P stacked in the feeder case 181 are fed toward the separation roller 184. Subsequently, the leading ends of the sheets of paper P are conveyed to a position between the separation roller 184 and the separation pad 185. As the separation roller 184 is driven to rotate counterclockwise in FIG. 11, only the uppermost sheet of paper P is fed toward the paper dust removing roller 187 where the paper dust is removed from the sheet of paper P. The sheet of paper P is then fed to the transfer unit 170 by way of the sheet conveyor roller 191 and the sheet guide member 192.

As the agitator 142 is driven to rotate in each of the developing cartridges 140, the toner in the cartridge case 141 of each developing cartridge 140 is agitated and supplied to the supply roller 143. The toner supplied to the supply roller 143 is then conveyed to the developing roller 144 by the counterclockwise rotation of the supply roller 143 in FIG. 11. The toner is electrically charged by friction at the position between the supply roller 143 and the developing roller 144 and adheres onto the outer peripheral surface of the developing roller 144. The toner adhered to the outer peripheral surface of the developing roller 144 is adjusted for density and the amount of electric charge to predetermined respective levels by means of the blade 145, and then is conveyed to the position between the developing roller 144 and the photosensitive drum 151 by the counterclockwise rotation of the developing roller 144.

Meanwhile, the outer peripheral surface of each photosensitive drum 151 is uniformly electrically charged by the charger 152, and is subsequently irradiated with a laser beam corresponding to image data. As a result, an electrostatic latent image corresponding to the image data is formed on the outer peripheral surface of the photosensitive drum 151. When the toner on the outer peripheral surface of the developing roller 144 contacts the outer peripheral surface of the photosensitive drum 151 where the electrostatic latent image is formed, the electrostatic latent image on the outer peripheral surface of the photosensitive drum 151 is developed by the toner, forming a toner image.

The sheet of paper P conveyed to the transfer unit 170 is supported on the conveyor belt 173 and conveyed toward the rear. When the sheet of paper P reaches a position between the photosensitive drum 151 and the transfer roller 174, the toner image on the outer peripheral surface of the photosensitive drum 151 is transferred onto the sheet of paper P due to the transfer bias voltage between the transfer roller 174 and the photosensitive drum 151. In this manner, a plurality of toner images of different colors are sequentially transferred onto the sheet of paper P, thereby forming a full-color image thereon. After the transfer operation, the outer peripheral surface of each photosensitive drum 151 is discharged by light emitted from the LEDs 153*a* on the LED substrate 153.

After passing through the transfer unit 170, the sheet of paper P with the full-color image formed thereon is conveyed to the fixing unit 193. As the sheet of paper P passes between the heating roller 193*a* and the pressure roller 193*b*, the toner on the surface of the sheet of paper P is fused and fixed onto the surface. Thereafter, the sheet of paper P is discharged onto the discharge tray 111*b* outside the main body 110.

As shown in FIGS. 7 and 9, the receiving electrodes 131*b* and 131*c* are disposed on the front surface of the front beam 131, and the supplying electrodes 114*a* and 114*b* are disposed on the front cover 111*e*, as described above. Thus, the receiving electrodes 131*b* and 131*c* do not gride or slide over the supplying electrodes 114*a* and 114*b* when mounting or removing the image forming unit 120 (the drum unit 130) in or from the main frame 112. Thus, the electrodes 131*b*, 131*c*, 114*a*, and 114*b* are not worn.

Also, because the receiving electrodes 131*b* and 131*c* are disposed to the upstream section of the drum unit 130 with respect to the mounting direction of the image forming unit 120 (the drum unit 130), it is possible to bring the receiving electrodes 131*b* and 131*c* into abutment with the supplying electrodes 114*a* and 114*b* with a simple configuration. Also, because the receiving electrodes 131*b* and 131*c* do not contact the supplying electrodes 114*a* and 114*b* when mounting the image forming unit 120 in the main frame 112, the electrodes 131*b*, 131*c*, 114*a*, and 114*b* can be prevented from being damaged.

Because the developing cartridges 140 and the drum sections 150 are arranged in a direction perpendicular to the rotary shafts of the photosensitive drums 151, a gear mechanism for the developing cartridges 140 and the drum sections 150 can be disposed remote from the receiving electrodes 131*b* and 131*c*. Thus, the configuration of the main frame 112 and the drum units 130 can be simplified, and the printer 100 and the drum units 130 can be assembled and serviced efficiently. That is, since such a gear mechanism is usually disposed on a side of rotary shafts of the photosensitive drums 151, it is difficult to dispose the receiving electrodes 131*b* and 131*c* on the front beam 131 or the rear beam 134 if the developing cartridges 140 and the drum sections 150 are arranged in a direction parallel to the rotary shafts of the photosensitive drums 151.

Because each of the LED substrates 153 relays power supplied from the receiving electrodes 131*b* and 131*c* to the other LED substrate 153, the lengths of the parts of the harness 154 can be the same for all the LED substrates 153. Therefore, the work load for manufacturing the LED substrates 153 and assembling the drum unit 130 can be reduced.

Because the receiving electrodes 121 (FIG. 3) are disposed through the support plate 133, and the supplying electrodes 112*e* to contact the corresponding receiving electrodes 121 are disposed inside main frame 112, all power receiving sections for receiving power to be supplied to the developing cartridges 140 and the LED substrates 153 are no longer necessary to be arranged on the front beam 131 in a concentrated manner. Thus, the degree of freedom for designing the drum unit 130 and the main frame 112 is remarkably increased.

Because each of the LED substrates 153 is disposed between the transfer unit 170 and the corresponding cleaning roller 156 when the image forming unit 120 is mounted in the main frame 112, the photosensitive drum 151 can be discharged immediately after the completion of the transfer operation.

Also, because the upper side and the lower side of each LED substrate 153 are protected by the cleaning cabinet 157 and the film member 158, toner scattered inside the main body 110 is prevented from adhering to the LEDs 153*a* and from blocking light emitted from the LEDs 153*a*. Thus, the photosensitive drums 151 can be reliably discharged.

Because the lower surface of the cleaning cabinet 157 and the upper surface of the film member 158 are coated with light reflecting paint, even if the amount of light emitted from the LED 153*a* is small, the light can be efficiently led to the outer peripheral surface of the photosensitive drum 151, and the photosensitive drum 151 can be reliably discharged.

While the invention has been described in detail with reference to the above aspects thereof, it would be apparent to those skilled in the art that various changes and modifications may be made therein without departing from the spirit of the invention.

For example, in the above-described printer 100, the receiving electrodes 131*b* and 131*c* are disposed on the front beam 131 disposed on the upstream side with respect to the mounting direction of the image forming unit 120. However, the receiving electrodes 131*b* and 131*c* may be disposed on the rear beam 134 disposed on the downstream side, or on both the front beam 131 and the rear beam 134.

In the above-described printer 100, the receiving electrodes 131*b* and 131*c* are electrically connected to the LED substrates 153. However, the receiving electrodes 131*b* and 131*c* may be electrically connected to the rotary shafts 144*a* of the development rollers 144.

The invention can also be applied to a printer that includes a photosensitive-member unit formed integrally with a plurality of image forming units, each having a photosensitive drum. The photosensitive-member unit includes a charging unit for charging the photosensitive drums, a developing unit for developing electrostatic images formed on the photosensitive drums, a transfer unit for transferring toner on the photosensitive drums onto a sheet of paper, and a discharging unit for discharging the electric charges of the photosensitive drums after the developing operation. In this case, the charging section, the developing section, the transfer unit, and the discharging unit can be replaced simultaneously.

What is claimed is:

1. An image forming device comprising:

an image-bearing unit including a plurality of image forming units each having an image bearing member on which an electrostatic latent image is formed; and a unit accommodating section, wherein:

the image-bearing unit is detachably accommodated in the unit accommodating section by being inserted in a first direction, the plurality of image forming units being arranged in the first direction when the image-bearing unit is inserted into the unit accommodating section;

the image-bearing unit includes a first support member extending in a second direction orthogonal to the first direction and a first receiving electrode disposed on the first support member, the first support member being located at one of an upstream end and a downstream end of the image-bearing unit with respect to the first direction, the first receiving electrode receiving electric power to be supplied to the image forming units; and the unit accommodating section includes a first supplying electrode that contacts the first receiving electrode in the first direction and supplies the electric power to the first receiving electrode; and further including:

a cover that is disposed at an upstream end of the unit accommodating section in the first direction, the cover being configured to displace between a closed state and an open state, wherein the first support member is located at an upstream end of the image-bearing unit with respect to the first direction; and wherein the first supplying electrode is disposed on the cover and the first receiving electrode is in opposition to the first supplying electrode when the cover is in the closed state with the image-bearing unit being accommodated in the unit accommodating section.

2. The image forming device according to claim 1, wherein the image-bearing member is rotatable about a rotary shaft extending in the second direction.

3. The image forming device according to claim 1, wherein the cover includes a shutter member that is displaceable between a first position to cover the first supplying electrode and a second position to expose the first supplying electrode.

4. The image forming device according to claim 3, further comprising a shutter displacing mechanism that displaces the shutter member to the second position when the cover is brought into the closed state with the image-bearing unit being accommodated in the unit accommodating section.

5. The image forming device according to claim 4, wherein the shutter displacing mechanism includes a pressed member fixed to the shutter member and a guide member disposed to the image-bearing unit, the guide member presses the pressed member when the cover is brought into the closed state with the image-bearing unit being accommodated in the unit accommodating section.

6. The image forming device according to claim 4, wherein the shutter member is configured to be urged from the second position toward the first position.

7. The image forming device according to claim 1, wherein each of the image forming units is configured to be electrically connected in parallel.

8. The image forming device according to claim 1, wherein:

each of the image forming units includes a developer accommodating section and a discharging unit that discharges the image-bearing member;

the image-bearing unit includes a second support member differing from the first support member and a second receiving electrode disposed on the second support member, the second receiving electrode receiving electric power to be supplied to the image forming units;

the unit accommodating section includes a second supplying electrode that contacts the second receiving electrode and supplies the electric power to the second receiving electrode when the image-bearing unit is accommodated in the unit accommodating section;

the first receiving electrode is in connection with one of the developer accommodating section and the discharging unit; and the second receiving electrode is in connection with the other of the developer accommodating section and the discharging unit.

9. The image forming device according to claim 8, further comprising a transfer unit that transfers developer from the image-bearing member to a recording medium, wherein each of the image forming units includes a cleaning unit that removes residual developer from the image-bearing member after the transfer unit has transferred the developer from the image-bearing member to the recording medium, and the discharging unit is disposed between the transfer unit and the cleaning unit when the image-bearing unit is accommodated in the unit accommodating section.

10. The image forming device according to claim 8, wherein the image-bearing member is made of a photoconductor, and the discharging unit includes a light source that irradiates light onto the image-bearing member, and each of the image forming units further includes a protect member that prevents developer from clinging onto the light source.

11. The image forming device according to claim 8, wherein the image-bearing member is made of a photoconductor, and the discharging unit includes a light source that irradiates light onto the image-bearing member, and each of the image forming units further includes a surrounding member that surrounds the light source, the surrounding member being configured to lead the light toward the image-bearing member.

12. An image-bearing unit that is detachably mountable on a section of an image forming device by being inserted in an inserting direction, the section including a first supplying electrode that supplies electric power, the image-bearing unit comprising:

a plurality of image forming units each including an image-bearing member on which an electrostatic latent image is formed, the plurality of image forming units being arranged in the inserting direction when the image-bearing unit is inserted into the section;

a first support member extending in a direction perpendicular to the inserting direction and located at one of an upstream end and a downstream end of the image-bearing unit with respect to the inserting direction;

a first receiving electrode that is disposed on the first support member, the first supplying electrode contacting the first receiving electrode in the inserting direction to supply the electric power to the first receiving electrode; and a guide member configured to displace a shutter member of the image forming device to expose a first supplying electrode of the image forming device, wherein the first receiving electrode is configured to receive the electric power from the first supplying electrode.

13. The image-bearing unit according to claim 12, wherein the image-bearing member is rotatable about a rotary shaft extending in the direction perpendicular to the inserting direction.

14. The image-bearing unit according to claim 12, wherein the first support member is disposed at an upstream end of the image-bearing unit with respect to the inserting direction.

15. The image-bearing unit according to claim 12, wherein each of the image forming units is configured to being electrically connected in parallel.

16. The image-bearing unit according to claim 12, further comprising a second support member differing from the first support member and a second receiving electrode disposed on the second support member, the second receiving electrode receiving electric power to be supplied to the image forming units; wherein each of the image forming units includes a developer accommodating section and a discharging unit that discharges the image-bearing member;

the first receiving electrode is in connection with one of the developer accommodating section and the discharging unit; and the second receiving electrode is in connection with the other of the developer accommodating section and the discharging unit.

17. The image-bearing unit according to claim 16, wherein each of the image forming units includes a cleaning unit that removes residual developer from the image-bearing member, and the discharging unit is disposed between the cleaning unit and a transfer unit of the image forming device that transfers developer from the image-bearing members onto a recording medium when the image-bearing unit is mounted on the section of the image forming device.

18. The image-bearing member according to claim 16, wherein the discharging unit includes a light source that irradiates light onto the image-bearing member, and each of the image forming units further includes a protect member that prevents developer from clinging onto the light source.

19. The image-bearing member according to claim 16, wherein the discharging unit includes a light source that irradiates light onto the image-bearing member, and each of the image forming units further includes a surrounding member that surrounds the light source, the surrounding member being configured to lead the light toward the image-bearing member.

* * * * *